US008608826B2

(12) United States Patent
Al-Hamouz

(10) Patent No.: US 8,608,826 B2
(45) Date of Patent: Dec. 17, 2013

(54) METHOD OF MODELING FLY ASH COLLECTION EFFICIENCY IN WIRE-DUCT ELECTROSTATIC PRECIPITATORS

(75) Inventor: Zakariya Mahmoud Al-Hamouz, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 504 days.

(21) Appl. No.: 13/084,447

(22) Filed: Apr. 11, 2011

(65) Prior Publication Data

US 2012/0255435 A1 Oct. 11, 2012

(51) Int. Cl.
*B03C 3/68* (2006.01)

(52) U.S. Cl.
USPC ..... 95/2; 95/57; 96/15; 96/18; 96/25; 96/96; 323/903; 700/273

(58) Field of Classification Search
USPC ..... 95/2–7, 57, 79–81; 96/15, 18–26, 75, 96/77, 80–82, 96; 700/266, 273; 323/903; 361/225–235
See application file for complete search history.

(56) References Cited

U.S. PATENT DOCUMENTS

| | | | | |
|---|---|---|---|---|
| 1,016,476 | A | 2/1912 | Cottrell | |
| 3,577,705 | A * | 5/1971 | Sharlit | 95/2 |
| 3,668,836 | A | 6/1972 | Richardson et al. | |
| 4,743,362 | A * | 5/1988 | Pfoh et al. | 209/127.4 |
| 5,282,891 | A | 2/1994 | Durham | |
| 5,922,103 | A * | 7/1999 | Schwab et al. | 95/8 |
| 6,447,580 | B1 | 9/2002 | Ridgeway et al. | |
| 6,540,812 | B2 * | 4/2003 | Farmer et al. | 95/2 |
| 7,094,274 | B2 | 8/2006 | Aradi et al. | |
| 7,300,493 | B2 * | 11/2007 | Kim et al. | 95/2 |
| 7,488,375 | B1 * | 2/2009 | Chen | 96/25 |
| 7,569,100 | B2 * | 8/2009 | Tanaka et al. | 96/18 |
| 7,736,418 | B2 * | 6/2010 | Graβ | 95/2 |
| 8,404,020 | B2 * | 3/2013 | Farmer et al. | 95/2 |
| 2002/0029690 | A1 | 3/2002 | Ridgeway et al. | |
| 2003/0182020 | A1 * | 9/2003 | Spencer et al. | 700/273 |
| 2005/0178265 | A1 * | 8/2005 | Altman et al. | 95/2 |
| 2007/0151446 | A1 * | 7/2007 | Younsi et al. | 95/2 |

FOREIGN PATENT DOCUMENTS

| | | | | |
|---|---|---|---|---|
| JP | 5-200324 A * | 8/1993 | | 95/3 |
| WO | WO2009150667 A2 | 12/2009 | | |

OTHER PUBLICATIONS

Al-Hamouz Z., "A Combined Algorithm Based on Finite Elements and Modified Method of Characteristics for the Analysis of Corona in Wire-Duct Electrostatic Precipitators", *IEEE Trans. IA*, vol. 38, pp. 43-49, 2002.

* cited by examiner

*Primary Examiner* — Richard L Chiesa
(74) *Attorney, Agent, or Firm* — Richard C. Litman

(57) ABSTRACT

The method of modeling fly ash collection efficiency in wire-duct electrostatic precipitators provides for the optimization of fly ash collection through the generation of numerical solutions to the electrostatic and electrodynamic equations associated with the particular geometry of the wire-duct electrostatic precipitator. Particularly, the solutions are developed through use of the finite element method and a modified method of characteristics.

20 Claims, 15 Drawing Sheets

100

METHOD OF MODELING FLY ASH COLLECTION EFFICIENCY IN WIRE-DUCT ELECTROSTATIC PRECIPITATORS

BACKGROUND OF THE INVENTION

1. Field of the Invention

The present invention relates generally to wire-duct electrostatic precipitators, and particularly to a method of modeling fly ash collection efficiency in wire-duct electrostatic precipitators.

2. Description of the Related Art

An electrostatic precipitator (ESP), or electrostatic air cleaner, is a particulate collection device that removes particles from a flowing gas (such as air) using the force of an induced electrostatic charge. Electrostatic precipitators are highly efficient filtration devices that minimally impede the flow of gases through the device, and can easily remove fine particulate matter, such as dust and smoke, from the air stream. In contrast to wet scrubbers, which apply energy directly to the flowing fluid medium, an ESP applies energy only to the particulate matter being collected, and therefore is very efficient in its consumption of energy (in the form of electricity).

The most basic precipitator contains a row of thin vertical wires, followed by a stack of large flat metal plates oriented vertically. The plates are typically spaced about 1 cm to 18 cm apart, depending on the particular application. The air or gas stream flows horizontally through the spaces between the wires, and then passes through the stack of plates. A negative voltage of several thousand volts is applied between the wires and plates. If the applied voltage is high enough, an electric (corona) discharge ionizes the gas around the electrodes. Negative ions flow to the plates and charge the gas-flow particles. The ionized particles, following the negative electric field created by the power supply, move to the grounded plates. Particles build up on the collection plates and form a layer. The layer does not collapse, due to electrostatic pressure (given from layer resistivity, electric field, and current flowing in the collected layer).

FIG. 1 diagrammatically illustrates a wire-duct electrostatic precipitator (WDEP) 100, and FIG. 2 is a schematic diagram of the WDEP of FIG. 1, illustrating some parameters of interest. A high voltage source HV is connected to high voltage rods 102, which have discharge wires 104 extending therebetween. Conductive plates 106 are placed on either side of the rods 102, and each plate 106 is grounded.

When the applied voltage is raised, the gas near the more sharply curved wire electrodes 104 breaks down at a voltage above what is referred to as the "onset value" and less than the "spark breakdown value". This incomplete dielectric breakdown, which is called a "monopolar corona", appears in air as a highly active region of glow. The monopolar corona within duct-type precipitators includes only positive or negative ions (the back corona is neglected), the polarity of the ions being the same as the polarity of the high voltage wires 104 in the corona. In FIGS. 1 and 2, the radius of each wire 104 is represented as R; S represents the wire-to-plate spacing (i.e., the distance between wires 104 and one of plates 106, measured along the Y-axis, as shown in FIG. 2); D represents the wire-to-wire spacing; and H represents the precipitator length (i.e., the length of each plate 106 measured along the X-axis, shown in FIG. 2).

For this configuration of WDEP, the following system of equations describes the monopolar corona:

$$\nabla\cdot\vec{E}=\rho/\epsilon_0 \tag{1}$$

$$\nabla\cdot\vec{J}=0 \tag{2}$$

$$\vec{E}=-\nabla\phi \tag{3}$$

$$\vec{J}=\vec{J}_{io}+\vec{J}_p \tag{4}$$

$$\vec{J}_{io}=k_{io}\rho_{io}\vec{E} \tag{5}$$

$$\vec{J}_p=k_p\rho_p\vec{E} \tag{6}$$

where $\vec{E}$ is the electric field intensity vector, $\rho$ is the total space charge density (i.e., the summation of the ion charge density $\rho_{io}$ and the particle charge density $\rho_p$, or $\rho=\rho_{io}+\rho_p$), $\vec{J}$ is the total current density vector, $\phi$ is the potential, $\epsilon_0$ is the permittivity of free space, and $k_{io}$ and $k_p$ are the mobilities for ions and particles, respectively.

Equations (1)-(6) represent Poisson's equation, the current continuity equation, the field and potential relations, the total current density equation, and the ion and particle current density equations, respectively. The exact analytical solution to these equations can only be obtained for parallel plates, coaxial cylinders, and concentric spheres. Because of the nature of this problem, a numerical solution would be desirable to provide solutions for this set of equations.

The following assumptions and boundary conditions are essential requirements for finding a numerical solution: First, the influence of particle space charge density on the field may be approximated by assuming that the particle concentration $N_p$ is constant over a given cross section of the precipitator 106. The particle's specific surface $S_p$ (i.e., the surface per unit volume of gas) is given as:

$$S_p=4\Pi a^2N_p \tag{7}$$

where a is the radius of assumed spherical particles.

The corona discharge is assumed to be distributed uniformly over the surface of the wires 104; if the corona electrode has a potential above a certain value (i.e., the onset level), the normal component of the electric field remains constant at the onset value $E_0$. Second, the ion mobility is assumed to be constant. And third, the ion diffusion is ignored.

With regard to boundary conditions, the potential at the two plates 106 is considered to be zero. Further, the potential at the discharging wires 104 is the potential of the source HV, which is denoted as V in the following. Lastly, the electric field at the discharging wires is $E_0$, which is given by:

$$E_0 = 3.1\times10^6\left(1+\frac{0.308}{\sqrt{0.5\times R}}\right). \tag{8}$$

Due to the complexities involved in the construction of solutions for equations (1)-(6), it is extremely difficult to optimize the collection of particulates, such as fly ash. However, it is often necessary to remove as many impurities from a fluid stream as possible. Thus, a method of modeling fly ash collection efficiency in wire-duct electrostatic precipitators solving the aforementioned problems is desired.

SUMMARY OF THE INVENTION

The method of modeling fly ash collection efficiency in wire-duct electrostatic precipitators provides for the optimization of fly ash collection through the generation of numerical solutions to the electrostatic and electrodynamic equations associated with the particular geometry of the wire-duct electrostatic precipitator. Particularly, the solutions are developed through use of the finite element method and a modified method of characteristics. The method includes the steps of: (a) modeling a monopolar corona of a wire-duct electrostatic precipitator as $\nabla\cdot\vec{E}=\rho/\in_0$, $\nabla\cdot\vec{J}=0$, $\vec{E}=-\nabla\phi$, $\vec{J}=\vec{J}_{io}+\vec{J}_p$, $\vec{J}_{io}=k_{io}\rho_{io}\vec{E}$, $\vec{J}_p=k_p\rho_p\vec{E}$, where $\vec{E}$ represents an electric field intensity vector, $\rho$ represents a total space charge density which is a summation of an ion charge density $\rho_{io}$ and a particle charge density $\rho_p$, $\vec{J}$ represents a total current density vector, $\vec{J}_{io}$ represents a current density vector for ions, $\vec{J}_p$ represents a current density vector for particles, $\phi$ represents a potential, $\in_0$ represents a permittivity of free space, and $k_{io}$ and $k_p$ represent mobilities for ions and particles, respectively, where the wire-duct electrostatic precipitator includes a pair of parallel plates with a plurality of discharging wires extending therebetween; and (b) generating a finite element boundary fitted grid matching a geometry of the wire-duct electrostatic precipitator, where the finite element boundary fitted grid is generated from an intersection of electric field lines, emanating from M finite element nodes selected on a circumference of each of the discharging wires, and N equipotential contours, where the intersection of the electric field lines with the N equipotential contours defines a plurality of quadrilaterals.

The method continues by: (c) calculating a set of estimated electric field magnitude values E at the M finite element nodes; (d) dividing each of the quadrilaterals into a pair of triangles to generate a plurality of triangular finite elements; (e) estimating the particle charge density $\rho_p$ at each of the nodes as $\rho_p=\in_0 f S_p E$, where f is a parameter dependent upon particle type; (f) establishing a plurality of flux tubes in the finite element boundary fitted grid respectively about the plurality of electric field lines such that ionic space charges flow along centers of the plurality of flux tubes; (g) estimating the ionic charge density $\rho_{io}$ along each of the flux tubes as $$\frac{d\rho_{io}}{dl}\hat{l}=-(\rho_{io}^2+\rho_{io}\rho_p)/\varepsilon_0 E,$$

where $\hat{l}$ is a unit vector along an axis of the flux tube; (h) approximating the potential $\phi$ within each of the finite elements as a linear function of coordinates as $\phi=\phi^e W^e=\phi_z w_z+\phi_s w_s+\phi_t w_t$, where z, s and t respectively represent nodes of element e, and w and W represent corresponding shape functions; (i) estimating a nodal potential error $e_r$ for each node relative to an average potential value $\phi_{av}$ for the node; (j) correcting an ionic space charge density $\rho_{i,1(io)}$ corresponding to an i-th flux tube if a maximum value of $e_r$ along the axis of the i-th flux tube exceeds a threshold value $\delta_1$; (k) repeating steps (e) through (j) until the maximum value of $e_r$ is less than the threshold value $\delta_1$; and (l) regenerating the finite element boundary fitted grid and repeating steps e) through j) until self-consistent solutions for $\phi$ and $\rho$ are obtained and a maximum difference between ionic space charge densities at the finite element nodes is less than a second threshold value $\delta_2$.

The method concludes with the steps of: (m) calculating a corona current I for each discharging wire as $$I=4\sum_{i=1}^{M}J_i A_{i,1},$$

where $J_i$ represents per-unit current density at the i-th flux tube and $A_{i,1}$ represents a corresponding per-unit cross-sectional area; and (n) calculating precipitator efficiency as $$\%\ \eta=1-\frac{C_{out}}{C_{in}}\times 100,$$

where $C_{in}$ and $C_{out}$ represent particle concentration at a precipitator inlet and outlet, respectively, and are given by $$C_{out}=C_{in}\exp\left(\frac{-S_c E\rho_p}{Q}\right),$$

where $S_c$ represents a total collecting surface area and Q represents a gas flow rate.

In the above, the potential at each of the parallel plates is set to zero and an electric field at each of the discharging wires $E_0$ is given by $$E_0=3.1\times 10^6\left(1+\frac{0.308}{\sqrt{0.5\times R}}\right),$$

where R represents a radius of each of the discharging wires. These are the initial boundary conditions for the numerical solutions.

Further, the step of calculating the set of estimated electric field magnitude values at the M finite element nodes includes calculation from a third order interpolating polynomial of the respective potentials. The parameter f is equal to 3 for conducting particles and the parameter f is equal to $$\frac{3\varepsilon}{\varepsilon+2}$$

for particles of relative permittivity $\in$.

Additionally, the step of correcting the ionic space charge density $\rho_{i,1(io)}$ includes establishing a new ionic space charge density $\rho_{i,1(io)new}$ given by $\rho_{i,1(io)new}=\rho_{i,1(io)}[1+g\,F_k]$, where i=1, 2, . . . , M, $e_r$ is updated as $$e_r=\frac{|\varphi_k^n-\varphi_k^{n+1}|}{\varphi_{av}},$$

n is an integer representing iteration number, $\phi_{av}=(\phi_k^n+\phi^{n+1})/2$, and $F_k$ is defined as $F_k=\text{Maximum}[\phi_k^{n+1}-\phi_k^n)/\phi_{av}]$, where g is an accelerating factor and the number of flux tubes is equal to M. The accelerating factor g is set equal to 0.5, and $\delta_2$ is preferably set to 0.1%.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
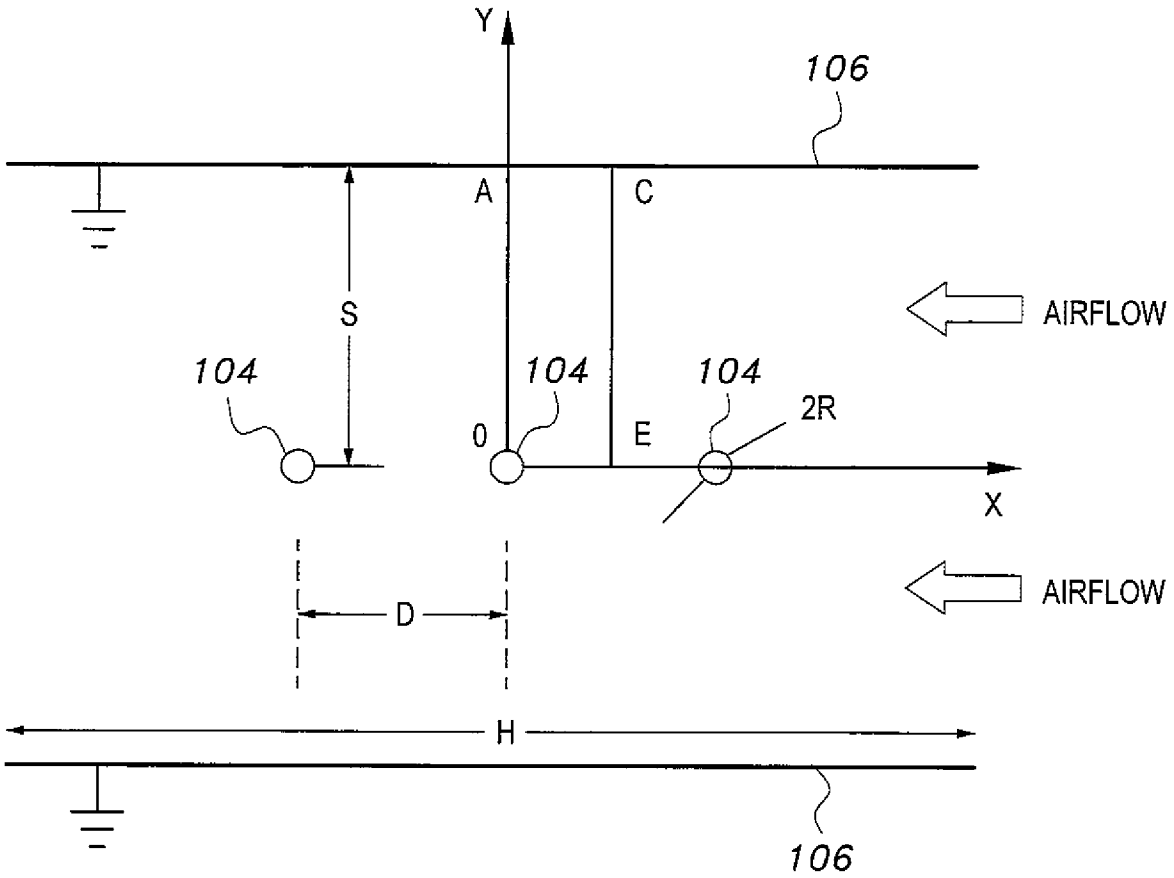
FIG. 2 is a schematic diagram of the wire-duct electrostatic precipitator of FIG. 1, illustrating selected parameters of interest.

Equations (1) through (6), given above, which describe the WDEP, are coupled partial differential equations (PDEs). Thus, one can solve the continuity equation if the electric field (or potential) is known, and can solve Poisson's equation if the ionic space and/or particle charge density values are assumed to be known. Due to the double symmetry in the precipitator geometry, as shown in FIG. 2, it is sufficient to study only the area defined by points A, o, E and C in FIG. 2 (denoted as area AoEC) for any number of corona wires 104, provided that symmetry is preserved.

Figure 3:
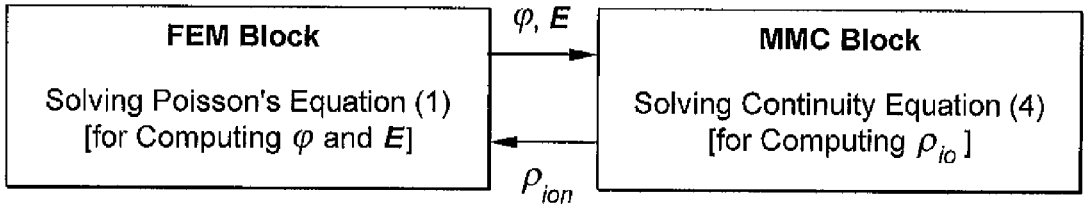
FIG. 3 is a block diagram illustrating method steps of the method of modeling fly ash collection efficiency in wire-duct electrostatic precipitators according to the present invention.

As a result of the double symmetry, the boundary conditions $E_x=0$ along the symmetry line o-A (where o is at the center of the corona wire 104) and $E_y=0$ along the symmetry line o-E (which is parallel to the grounded plates 106) are indirectly satisfied. Therefore, the solution algorithm consists of two coupled blocks: the finite element method (FEM) block and the modified method of characteristics (MMC) block, as illustrated in FIG. 3. The FEM block is used for solving Poisson's equation (1) to compute yo and E, while the MMC block is used to solve the continuity equation (4) to compute the ionic space charge density $\rho_{io}$.

Figure 4:
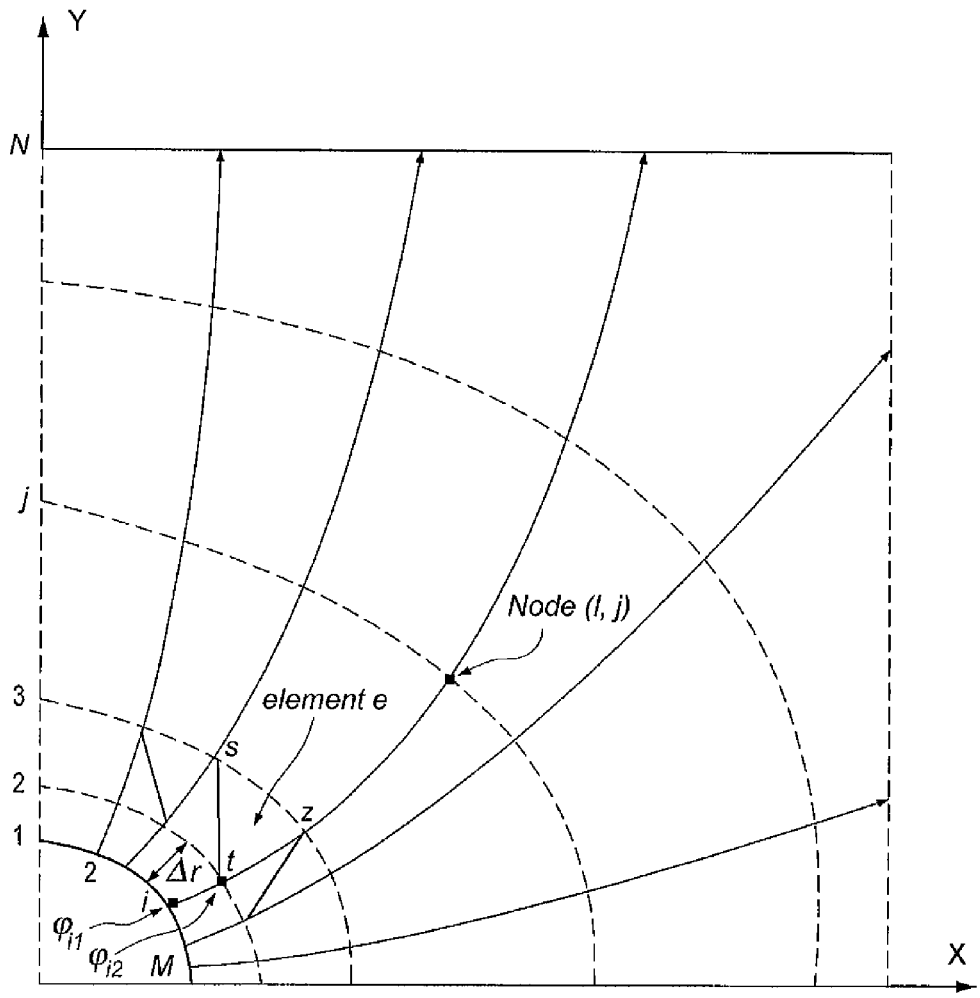
FIG. 4 is a diagram illustrating the formation of a finite element grid in the method of modeling fly ash collection efficiency in wire-duct electrostatic precipitators according to the present invention.

The first step in solving the equation set is the generation of a finite element (FE) boundary fitted grid that is matched to the WDEP geometry. The grid is generated from the intersection of field lines, which emanate from M nodes selected on the circumference of the discharging conductor, and N equipotential contours, as shown in FIG. 4. The grid is made fine in the regions of high field gradient, and becomes coarse in regions of low field gradients. After generating the free space charge FE grid, the electric field values at the FE nodes are determined from a third order interpolating polynomial of the potentials. Dividing each quadrilateral formed from the intersection of field lines with equipotential contours into two triangles generates the triangular finite elements.

The next step is the estimation of particle and ionic charge densities. Using the estimated electric field values on the FE grid nodes, the particle charge density $\rho_p$ at each node is calculated as:

$$\rho_p=\in_0 f S_p E \tag{9}$$

where f=3 for conducting particles and $f=3\in/\in+2$ for particles of relative permittivity $\in$. In other words, $$\rho_p=\xi E \tag{10}$$

$$\xi=4\lceil\in_0 f a^2 N_p \tag{11}$$

and the particle mobility can be calculated as:

$$k_p=\rho_p/6\Pi N_p \gamma a \tag{12}$$

where $\gamma$ is the air viscosity.

The first estimate of the ionic space charge density values at the FE grid nodes can be made by satisfying the current continuity equation (2) using the MMC. The method of characteristics is based on a technique in which the partial differential equation governing the evolution of charge density becomes an ordinary differential equation along specific "characteristic" space-time trajectories. In the present invention, a modified method of characteristics (MMC) is used in which the partial differential equation governing the evolution of charge density becomes an ordinary differential equation along specific "flux tube" trajectories.

Thus, special flux tubes are introduced for this purpose, as shown in FIG. 4, which start at the surface of the discharging wire and terminate at the grounded plates. The ionic space charges are assumed to flow along the centers of these flux tubes; i.e., the field lines. Therefore, the problem that the characteristic lines never follow the FE grid pattern is eliminated by this method:

$$\nabla\cdot\vec{J}=\nabla\cdot(k_{io}\rho_{io}E+k_p\rho_pE)=0. \tag{13}$$

To simplify satisfying the continuity condition, particle charge density values $J_p=k_p\rho_pE$ are assumed constant in each iteration. Thus, equation (13) has been simplified to solve for the ionic space charge density values at the FE grid nodes. As a result, equation (13) can be written along each flux tube as:

$$\frac{d\rho_{io}}{dl}\hat{l}=-(\rho_{io}^2+\rho_{io}\rho_p)/\varepsilon_0E \tag{14}$$

where $\hat{l}$ is a unit vector along the axis of the flux tube; i.e., along the direction of E.

For known values of the ionic space charge and particle charge densities at the FE nodes, Poisson's equation (1) is solved in the area AoEC by means of the FEM. The potential $\phi$ within each finite element is approximated as a linear function of coordinates, namely:

$$\phi=\phi^eW^e=\phi_zw_z+\phi_sw_s+\phi_tw_t \tag{15}$$

with z, s, and t representing the nodes of the element e, and where W is the corresponding shape function. The constancy of the electric field at the discharging wire at a value of $E_0$ is directly implemented into the FE formulation. This is achieved by noting that $(\phi_{i,1}-\phi_{i,2})\Delta r_i=E_0$ where $\Delta r_i$ is the radial distance between the first two nodes along the axis of any flux tube, as shown in FIG. 3. Since $\phi_{i,1}$ is the applied voltage, which is known, then $\phi_{i,2}$, the potential at node (i,2), the i-th node along the second equipotential contour, is also known and hence the boundary condition of constant electric field at the discharging wire is satisfied. It should be noted that $\Delta r_i$ is much smaller than the discharging wire radius. The electric field values at the FE nodes are determined from a third order interpolating polynomial of the potentials.

The next step in the solution is particle and space charge density correction. Using the estimated electric field values at the FE nodes, the particle charge density at these nodes is updated using equations (9) through (12). Correction of the ionic space charge density is made by comparing the computed values of the potential at the k-th node in iterations n and n+1. A nodal potential error $e_r$ relative to the average value of the potential $\rho_{av}$ at that node is estimated. If the maximum of $e_r$ along the axis of the i-th flux tube exceeds a pre-specified value $\delta_1$, a correction of the ionic space charge density values $\rho_{i,1(io)}$ (corresponding to the i-th flux tube) is made according to the maximum nodal error, as in equations (16a)-(16d):

$$\rho_{i,1(io)_{new}}=\rho_{i,1(io)_{old}}[1+gF_k]\ i=1,2,\ldots,M \tag{16a}$$

$$e_r=|\phi_k^n-\phi_k^{n+1}|/\phi_{av} \tag{16b}$$

where $$\phi_{av}=(\phi_k^n+\phi_k^{n+1})/2 \tag{16c}$$

$$F_k=\text{Maximum}[(\phi_k^{n+1}-\phi_k^n)/\phi_{av}] \tag{16d}$$

where g is an accelerating factor taken to be equal to 0.5, and M is the number of flux tubes. The ionic space charge density values at the rest of the FE nodes are estimated again by solving equation (14).

The next step in the solution method is iteration to converge to a self-consistent solution. The second step (the estimation of particle and ionic charge densities), the third step (the finite element solution of Poisson's equation) and the fourth step (the particle and space charge density correction) are repeated until the maximum nodal potential error of equation (16b) is less than a pre-specified value $\delta_1$.

The sixth step is the generation of the next FE grid. The finite element grid is regenerated taking into account the latest nodal ionic $\rho_{io}$ and particle space charge values $\rho_p$ until a self-consistent solution is obtained again for $\phi$.

This process of grid generation and obtaining self-consistent solutions for $\phi$ and $\rho$ continues until, for the last two generations, the maximum difference of the ionic space charge density $\rho_{io}$ at the FE nodes is less than a pre-specified value ($\delta_2$ taken as 0.1% in the present method).

The final step is the calculation of corona current and efficiency. For the whole discharging wire, the corona current is calculated as:

$$I=4\sum_{i=1}^{M}J_iA_{i,1} \tag{17}$$

where $J_i$ is the per-unit current density at the i-th flux tube, and $A_{i,1}$ is the corresponding per unit cross-sectional area.

Finally, the precipitator efficiency is calculated as:

$$\%\ \eta=1-\frac{C_{out}}{C_{in}}\times 100 \tag{18}$$

$$C_{out}=C_{in}\exp\left(\frac{-S_cE\rho_p}{Q}\right) \tag{19}$$

where $C_{in}$ and $C_{out}$ are the particle concentration at the precipitator inlet and outlet, respectively, $S_c$ is the total collecting surface area, and Q is the gas flow rate.

Figure 1:
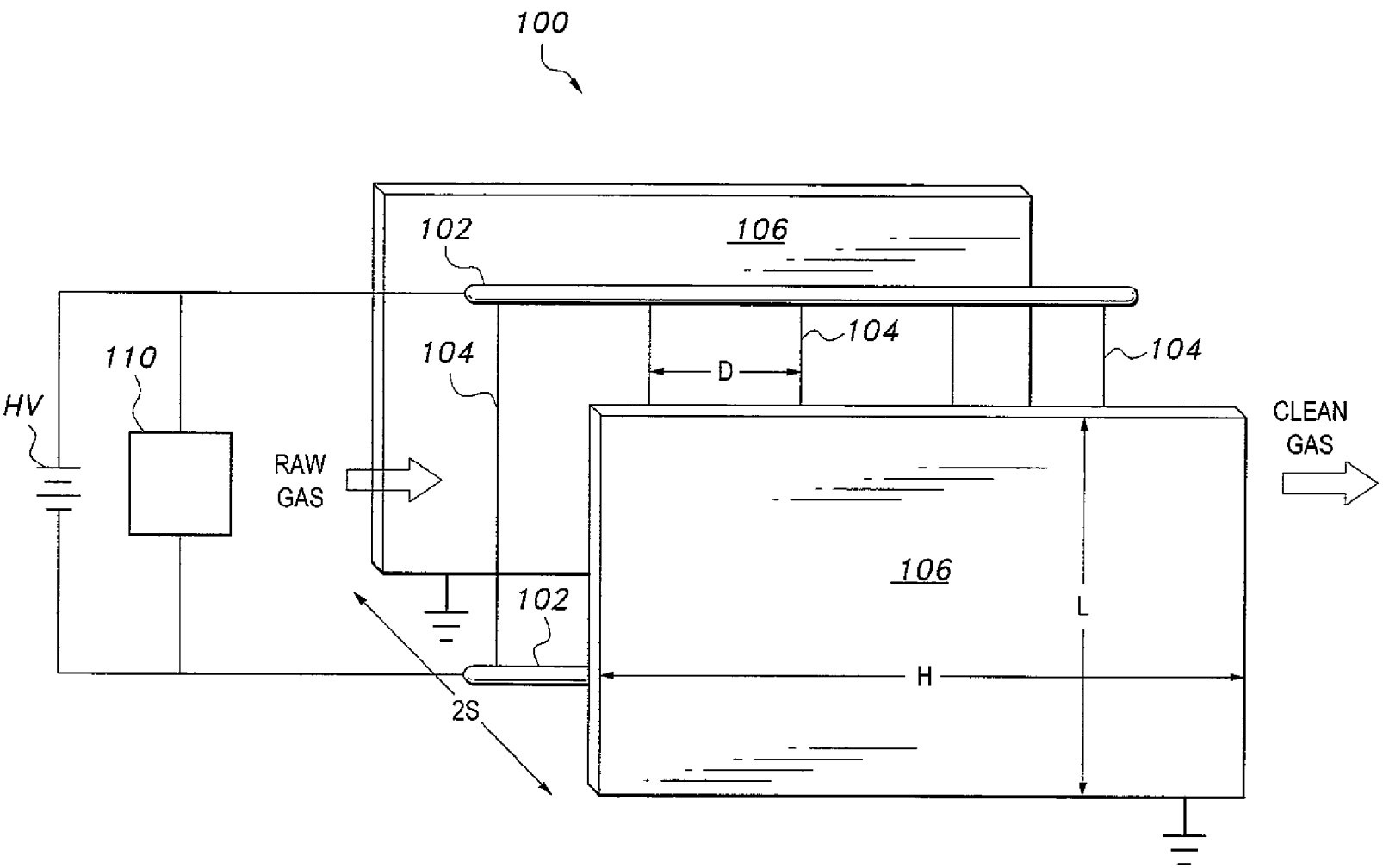
FIG. 1 is a diagrammatic perspective view of a wire-duct electrostatic precipitator used in the present method of modeling fly ash collection efficiency in wire-duct electrostatic precipitators according to the present invention.

In order to test the above method, a WDEP similar to WDEP 100 of FIGS. 1 and 2 was assembled with high voltage source HV providing a voltage of up to ±100 kV, the raw gas being fed into the WDEP 100 by a conventional blower 110. The collection plates 106 each had a length of approximately two meters and a width of approximately one meter. The components illustrated in FIGS. 1 and 2 were sealed within a flexiglass housing. All sharp edges were covered by insulation material to eliminate the possibility of un-needed corona. The experimental system further included the ability to change the distance between plates 106, as well as the discharging wire-to-wire spacing, and the discharging wire radii, along with the air flow velocity.

Figure 5:
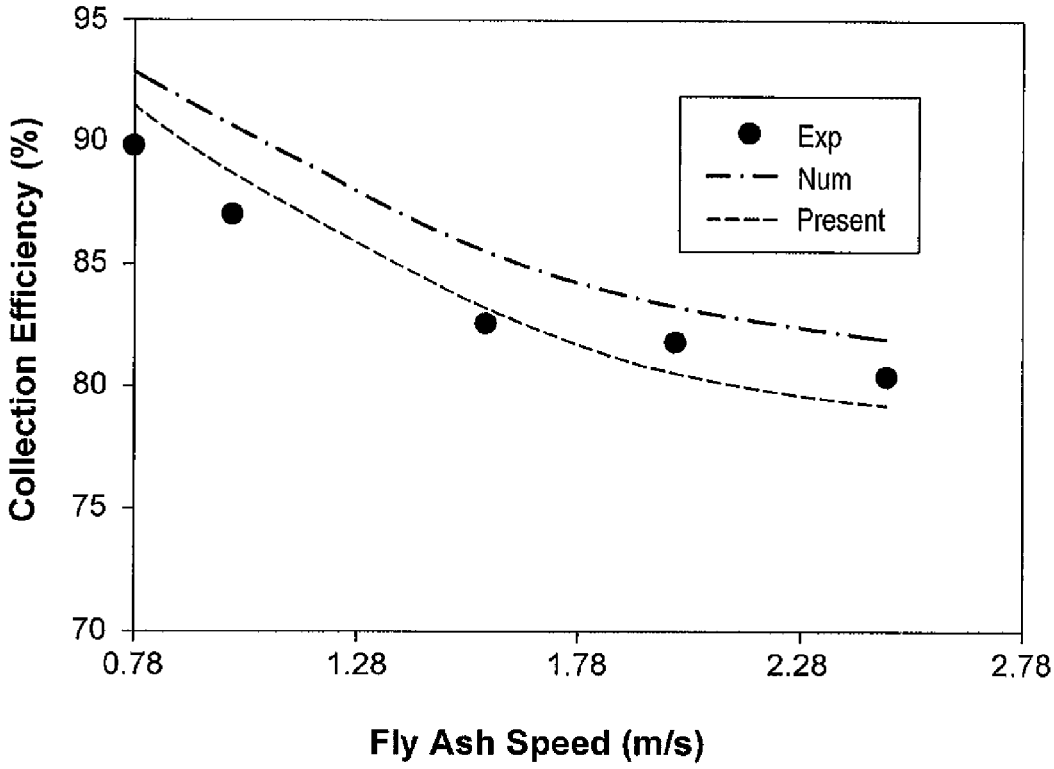
FIG. 5 is a graph showing collection efficiency as a function of fly ash speed, comparing collection efficiencies for conventional numeric techniques, experimental values, and values computed by the present method of modeling fly ash collection efficiency in wire-duct electrostatic precipitators according to the present invention.

To test the effectiveness of the above numerical method, collection efficiency at different fly ash speeds was measured and compared against numerical calculations, as shown in FIG. 5. For the WDEP 100 shown in FIGS. 1 and 2, R=1.0 mm, S=0.15 m, D=0.0375 m, and the applied voltage is 50 kV. In FIG. 5, experimental results "Exp" are compared against earlier numerical calculations using traditional numerical methods, and the present method described above. The present method is shown to have greater conformance with the experimental data.

Figure 6:
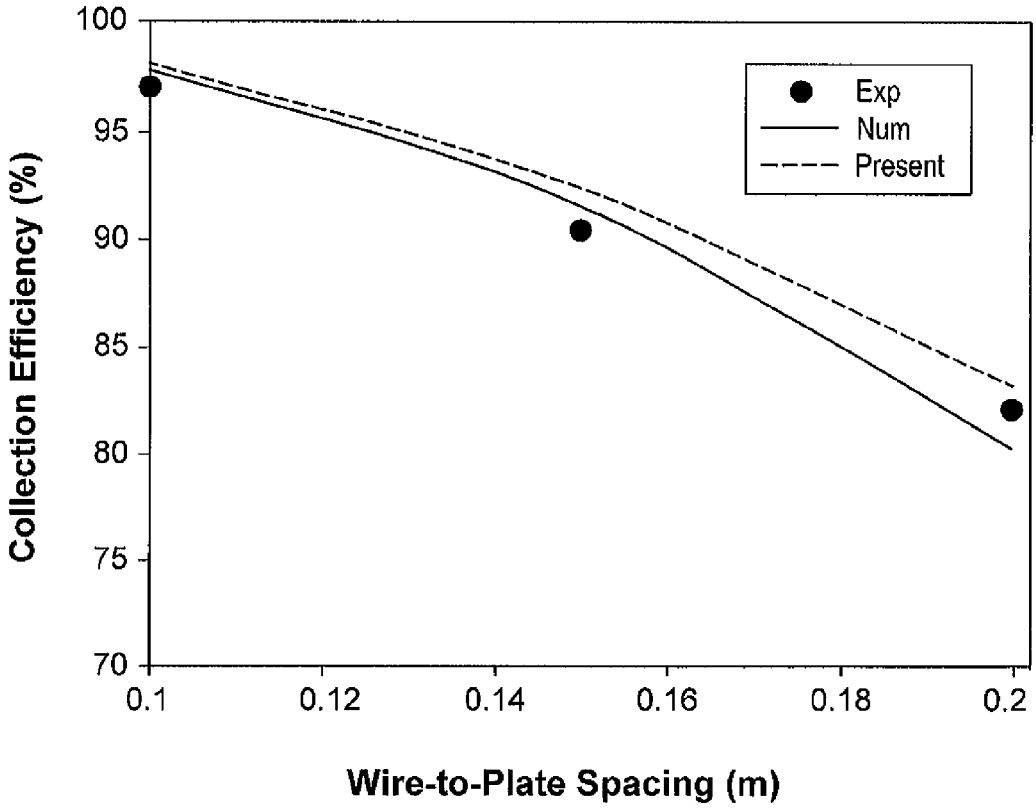
FIG. 6 is a graph showing collection efficiency as a function of wire-to-plate spacing, comparing collection efficiencies for conventional numeric techniques, experimental values, and values computed by the present method of modeling fly ash collection efficiency in wire-duct electrostatic precipitators according to the present invention.

FIG. 6 illustrates similar results, but for a different wire-to-plate spacing; i.e., R=1.0 mm, D=0.025 m, fly ash speed=1.0 m/s, and the applied voltage is 50 kV. In this example, it can again be seen that the present calculated values are in excellent agreement with the experimental results.

Figure 7:
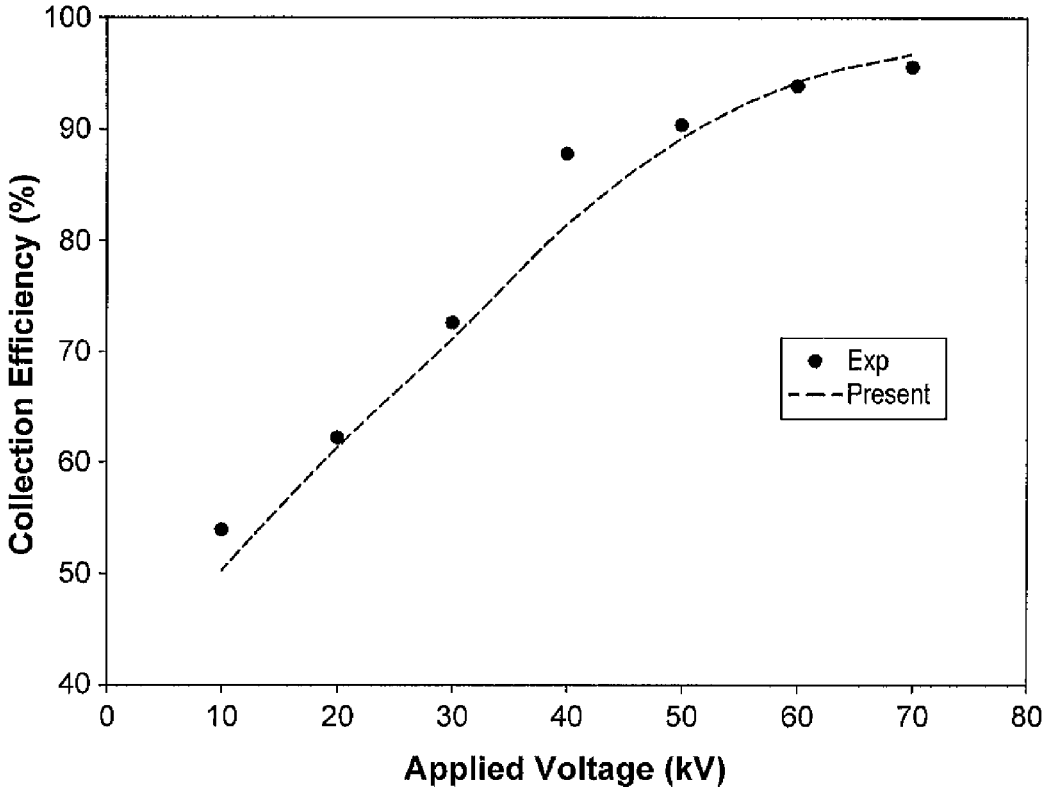
FIG. 7 is a graph showing collection efficiency as a function of applied voltage, comparing collection efficiencies for experimental values and values computed by the present method of modeling fly ash collection efficiency in wire-duct electrostatic precipitators.

FIG. 7 illustrates a third WDEP configuration, where R=1.0 min, S=0.15 m, D=0.0375 m, and fly ash speed=1 m/s. In FIG. 7, the applied voltage V is varied. Using the experimental set-up, the present computational method values were compared to the measured collection efficiency. Table 1 below illustrates a detailed view of fly ash particle size distribution, where the majority of particles (around 78.4%) are below 10 μm in size.

TABLE 1

Particle size distribution

| Particle size (μm) | % |
|---|---|
| 0.1-1 | 0.8 |
| 1-3 | 3.4 |
| 3-4.5 | 14.6 |
| 4.5-6.5 | 19.2 |
| 6.5-8.5 | 24.3 |
| 8.5-10 | 16.1 |
| 10-13 | 13.5 |
| >13 | 8.1 |

The basic geometrical and operating parameters used are listed below in Table 2:

TABLE 2

Geometry and operating parameters of the laboratory set-up

| Parameter | Value |
|---|---|
| Length of collection plate (ESP length in m) | 2 |
| Height of collection plate (ESP height in m) | 1 |
| Spacing between collecting and discharging electrode | 0.3 and 0.4 |
| Spacing between discharging electrodes (m) | 0.16 and 0.21 |
| Radii's of discharging electrodes (mm) | 0.35, 0.5, 0.85 |
| Air flow velocity (m/s) | 0.5-2.2 |
| Atmospheric pressure (Pa) | 1 |
| Ion mobility ($m^2$/Vs) | $1.82 \times 10^{-4}$ |
| Supply Voltage (kV) | 0-100 |
| Temperature of gas (K) | 293 |

Figure 8:
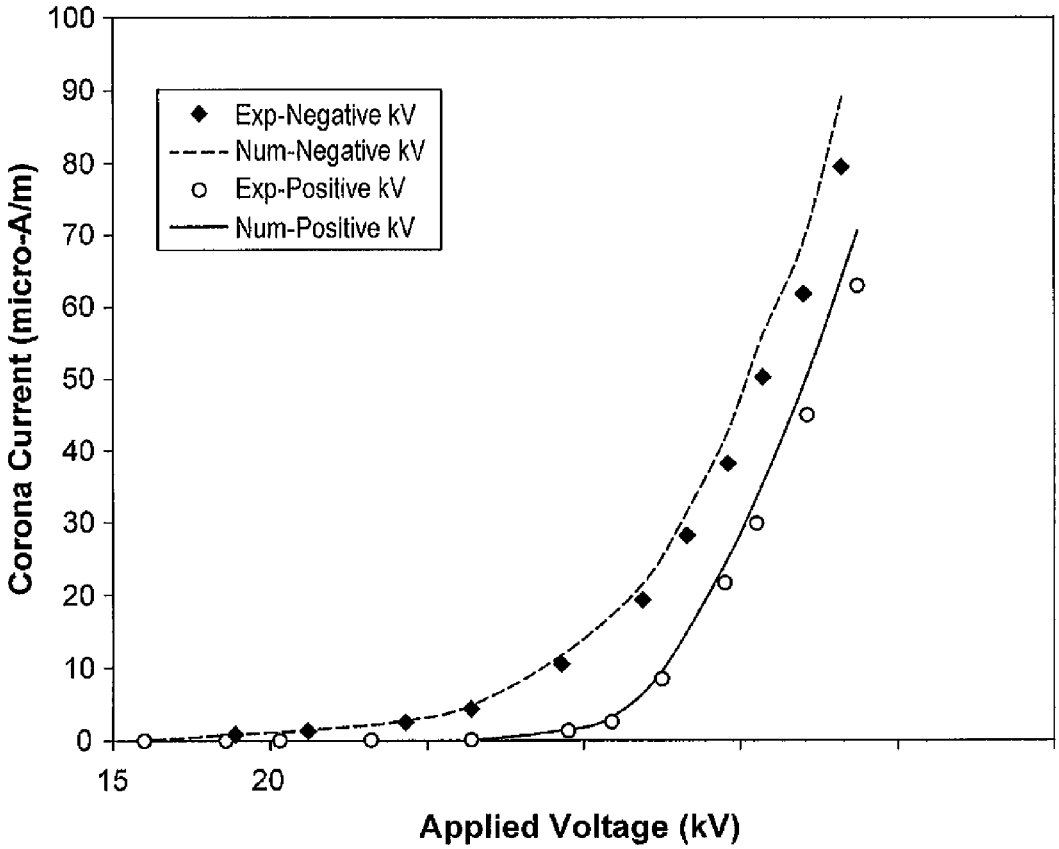
FIG. 8 is a graph showing corona current as a function of applied voltage, comparing corona current for experimental values and values computed by the present method of modeling fly ash collection efficiency in wire-duct electrostatic precipitators according to the present invention.
Figure 9:
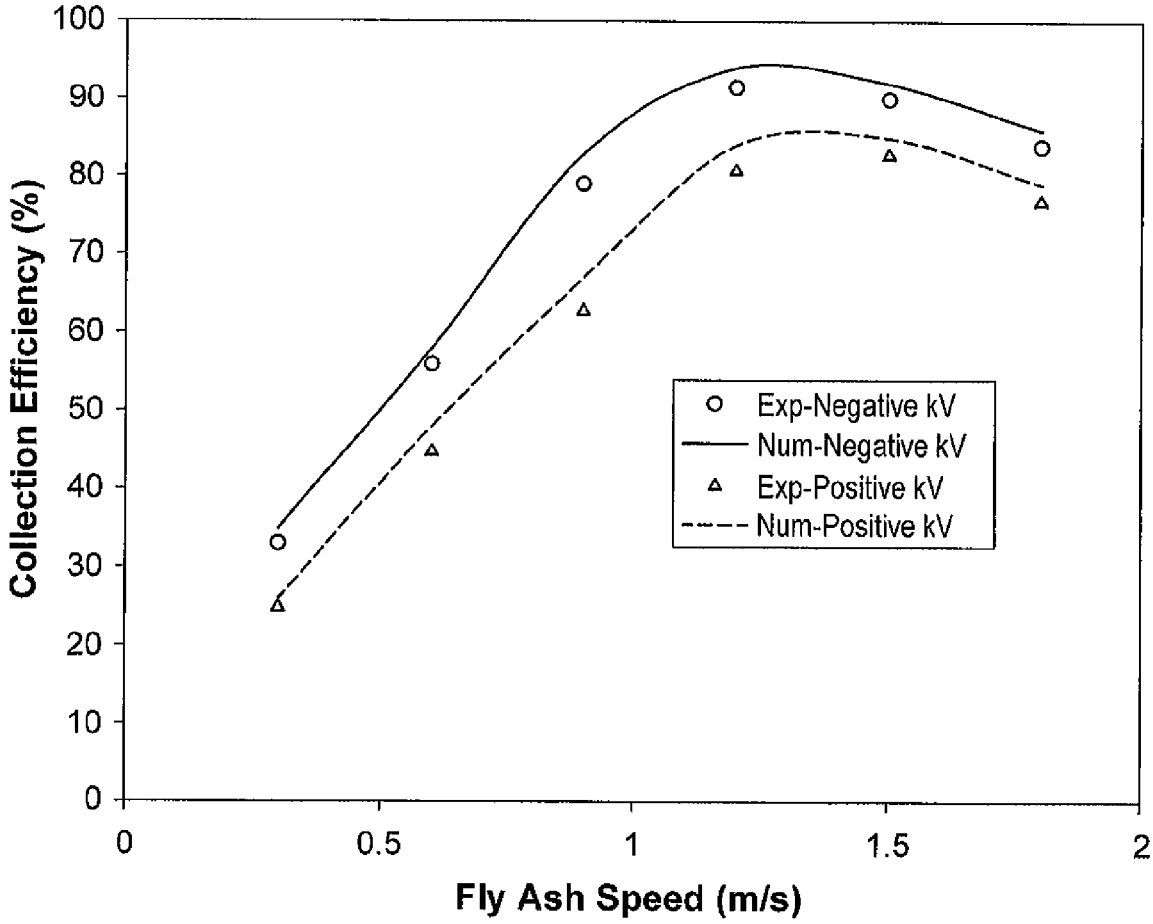
FIG. 9 is a graph showing collection efficiency as a function of fly ash speed, comparing collection efficiencies for experimental values and values computed by the present method of modeling fly ash collection efficiency in wire-duct electrostatic precipitators according to the present invention.

For positive and negative applied voltages, the corona current characteristics are shown in FIG. 8. The agreement between the computed and experimental values is satisfactory, as shown. At constant operating positive and negative voltages of 27 kV, the fly ash collection efficiency was been measured and computed by the above method. In order to select the optimum fly ash flow speed, FIG. 9 demonstrates the effect of fly ash speed on the collection efficiency. From this Figure, it is clear that a fly ash speed of around 1.2 m/s will result in maximum collection efficiency. Also, the Figure demonstrates the effect of the applied voltage polarity on the collection efficiency. It is quite clear that the collection efficiency is higher for negative applied voltages (94% for negative voltage as compared to 83% for positive voltage). Accordingly, fly ash flow speed of 1.2 m/s is found to provide optimal collection efficiency.

Figure 10:
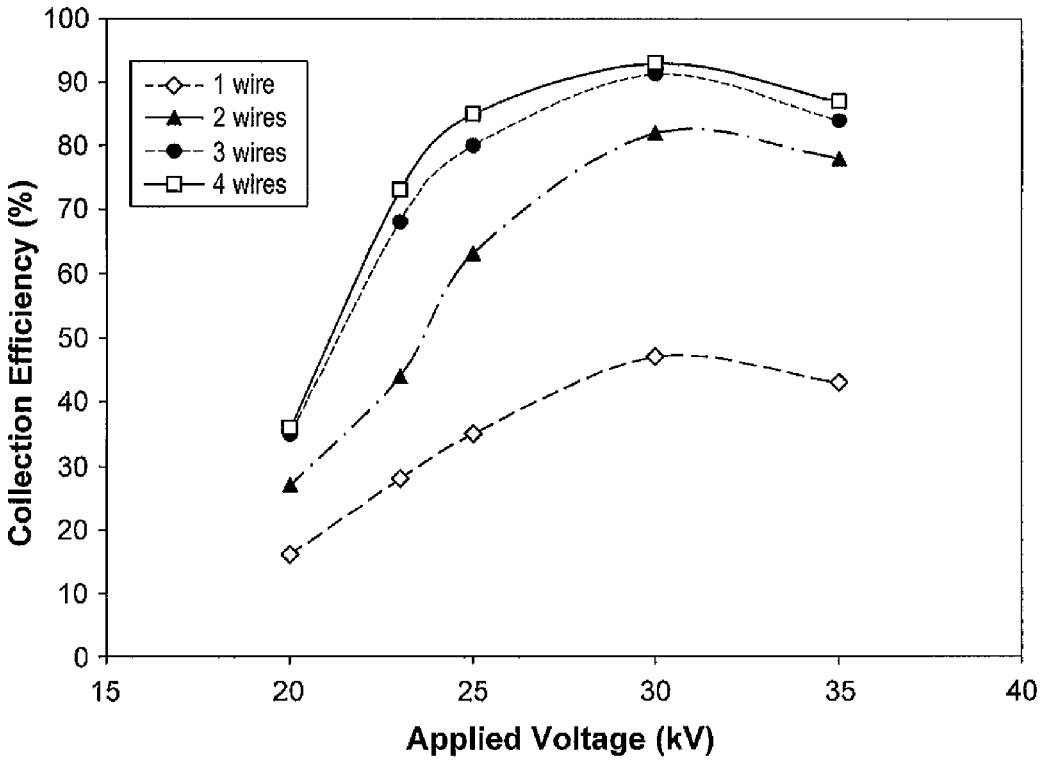
FIG. 10 is a graph showing collection efficiency as a function of applied voltage, comparing collection efficiencies for experimental values by the present method of modeling fly ash collection efficiency in wire-duct electrostatic precipitators according to the present invention, comparing efficiencies according to the number of discharging wires.

The effect of varying the number of discharging wires on the collection efficiency is shown in FIG. 10, where it can be seen that increasing the number of wires increases the efficiency. It can also be seen that using four discharging wires 104 will slightly improve the collection efficiency, as compared to using three such wires.

Figure 11:
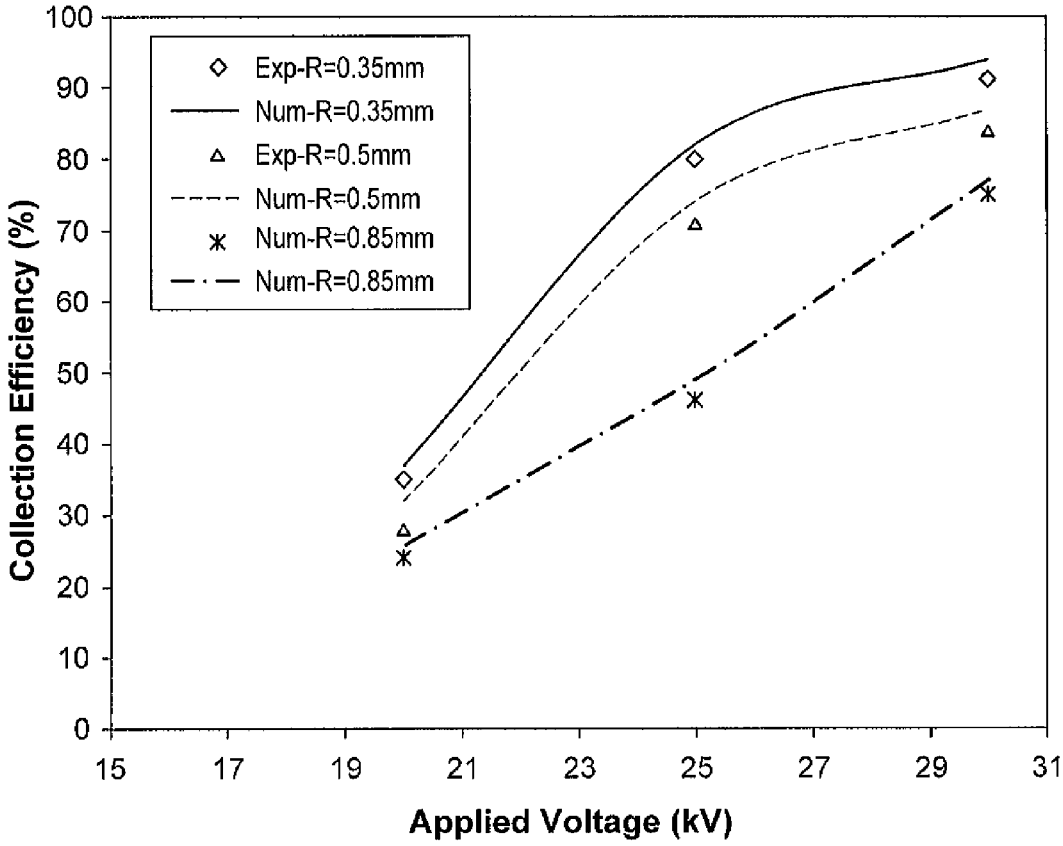
FIG. 11 is a graph showing collection efficiency as a function of applied voltage, comparing collection efficiencies for experimental values and values computed by the present method of modeling fly ash collection efficiency in wire-duct electrostatic precipitators according to the present invention, comparing efficiencies according to the discharging electrode radius.

The present measured and computed collection efficiency with varying discharging electrode radii is shown in FIG. 11, where, in this example, S=0.16 m, D=0.3 m, and fly ash speed is equal to the optimal 1.2 m/s. It is clear from FIG. 11 that as the discharging electrode radius increases, the collection efficiency decreases. This is due to the increase in the corona onset voltage and, thus, a reduction in the ionization process.

Figure 12:
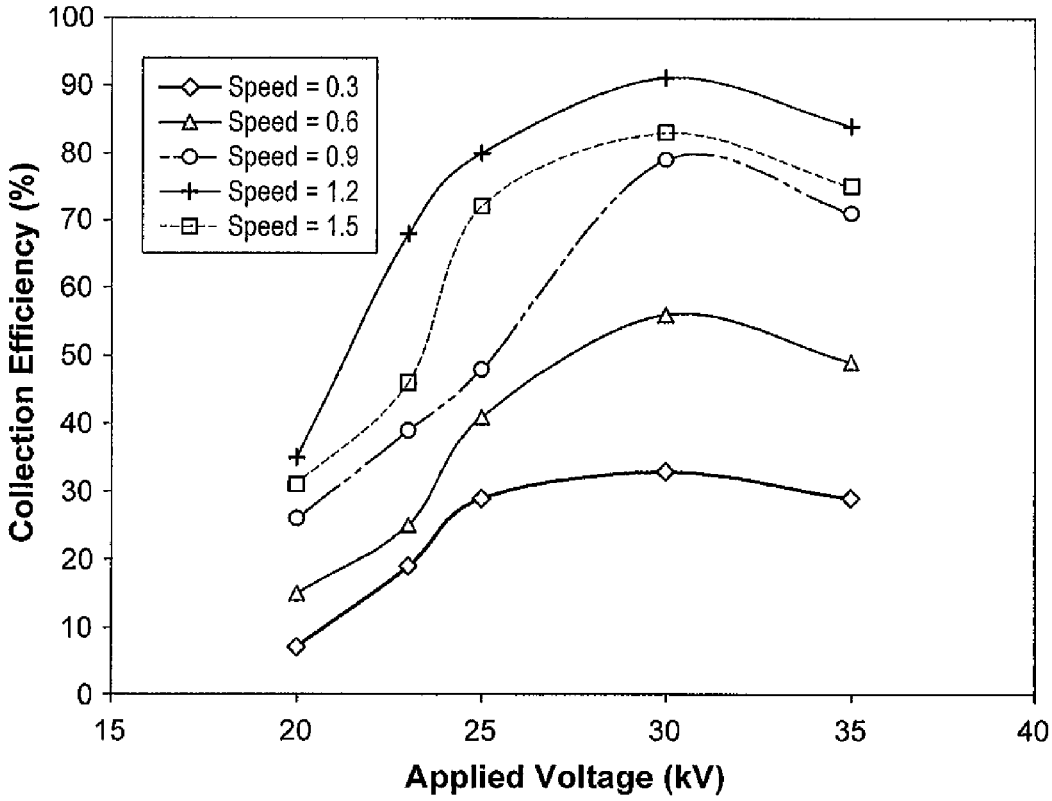
FIG. 12 is a graph showing collection efficiency as a function of applied voltage, comparing collection efficiencies for experimental values by the present method of modeling fly ash collection efficiency in wire-duct electrostatic precipitators according to the present invention, comparing efficiencies according to the fly ash speed.

For a WDEP configuration where R=0.35 mm, S=0.16 m, and D=0.3 m, FIG. 12 demonstrates the variation of the collection efficiency as the fly ash speed varies. It is quite clear that at low fly ash speeds (0.3 and 0.6 m/s), the maximum collection efficiency barely reaches 50%. On the other hand, the collection efficiency profile is the highest at a fly ash speed of 1.2 m/s. When the fly ash speed is increased to 1.5 m/s, the collection efficiency profile become lower than that for a speed of 1.2 m/s. This can be attributed to the fact that as the fly ash speed becomes more than a certain value, the chance that the particles will be charged (and thus follow the electric field lines) will be reduced.

Figure 13:
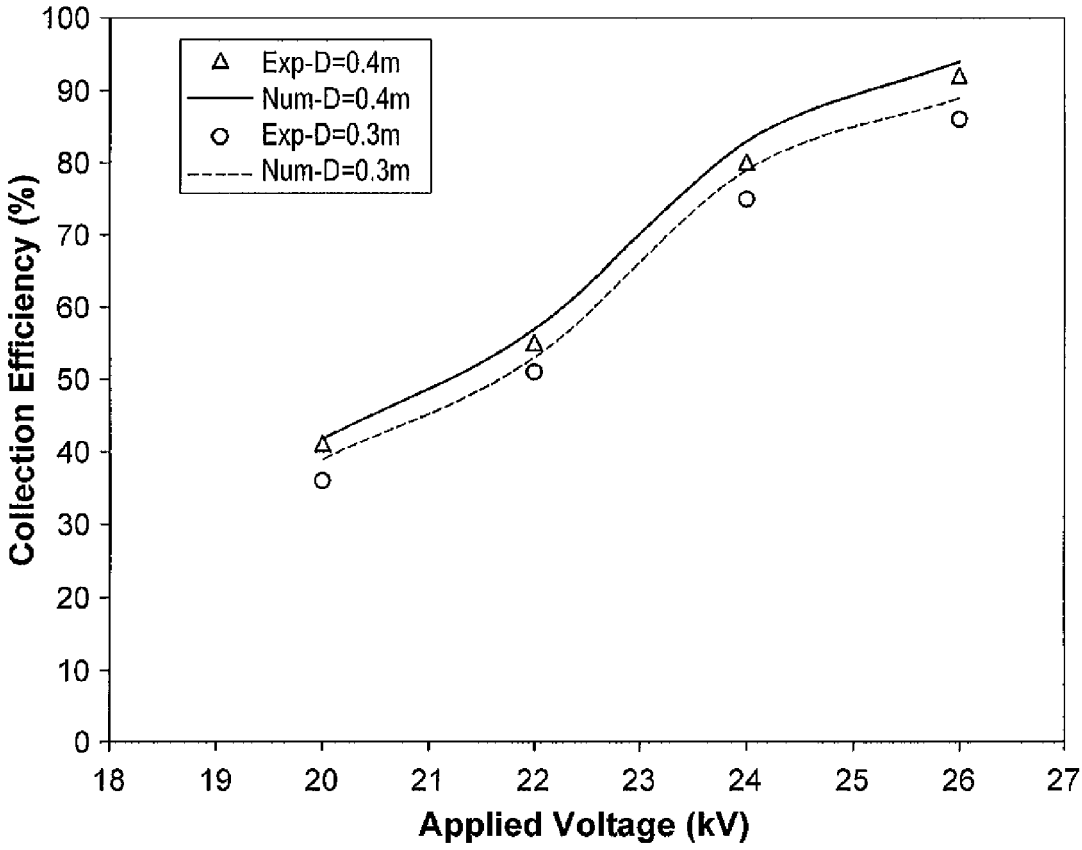
FIG. 13 is a graph showing collection efficiency as a function of applied voltage, comparing collection efficiencies for experimental values and values computed by the present method of modeling fly ash collection efficiency in wire-duct electrostatic precipitators according to the present invention, comparing efficiencies according to wire-to-wire spacing.
Figure 14:
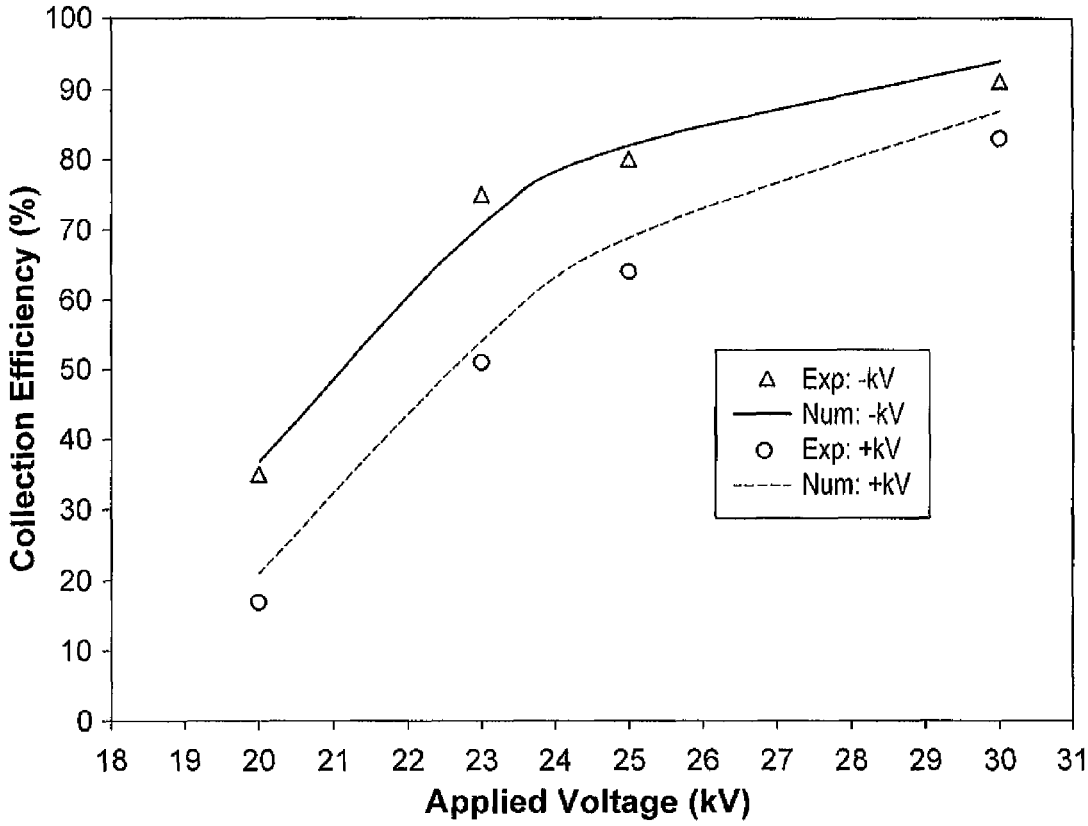
FIG. 14 is a graph showing collection efficiency as a function of applied voltage, comparing collection efficiencies for, experimental values and values computed by the present method of modeling fly ash collection efficiency in wire-duct electrostatic precipitators according to the present invention, comparing efficiencies according to voltage polarity.

The effect of discharging wire-to-wire spacing on the collection efficiency for the configuration where S=0.16 m, R=0.35 mm, and with fly ash speed of 1.2 m/s, is shown in FIG. 13. It can be seen that as the wire-to-wire spacing increases, the collection efficiency increases as the electric field screening effect is reduced. Finally, the effect of the applied voltage polarity on the collection efficiency for the configuration where S=0.16 m, R=0.35 mm, and fly ash speed of 1.2 m/s, is shown in FIG. 14. It is clearly seen from this Figure that the collection efficiency with negative voltage is higher than for positive one. The higher collection efficiency of the negative polarity can be explained by a higher discharge current (due to higher ion mobility and resulting higher charged-particle density) for the same voltage.

From the comparisons demonstrated above, it can be seen that the calculated values predicted by the present method are in good agreement with experimental results. Additionally, the FE grid is generated in a relatively simple way in which the characteristic lines follow the FE grid pattern. This will, in effect, reduce the number of FE grid re-generations needed to achieve convergence.

Further, conventional numerical methods call in their programming for two inner loops to guarantee convergence: one for the convergence of the potential and the other for the convergence of electric field to the onset value. An outer loop to update the mapped field lines (i.e., the FE grid) is also required, which means that a total of three loops are needed for convergence of the conventional methods. The present method, however, requires only one loop to guarantee the convergence of the potential and one loop to update the FE grid. Thus, a total of two loops are needed to guarantee convergence. For example, for one of the configurations, the present method requires two grid generations and five iterations (a total of ten iterations) to convergence with an accuracy of 0.1% in the computed results. One conventional method uses a total number of iterations needed for conversion of between 15 and 28, with an accuracy of less than 1% in the computed results. This reduction in the number of iterations is attributed to the fact that the FE grid is generated from the intersection of field lines and equipotential contours.

Figure 15:
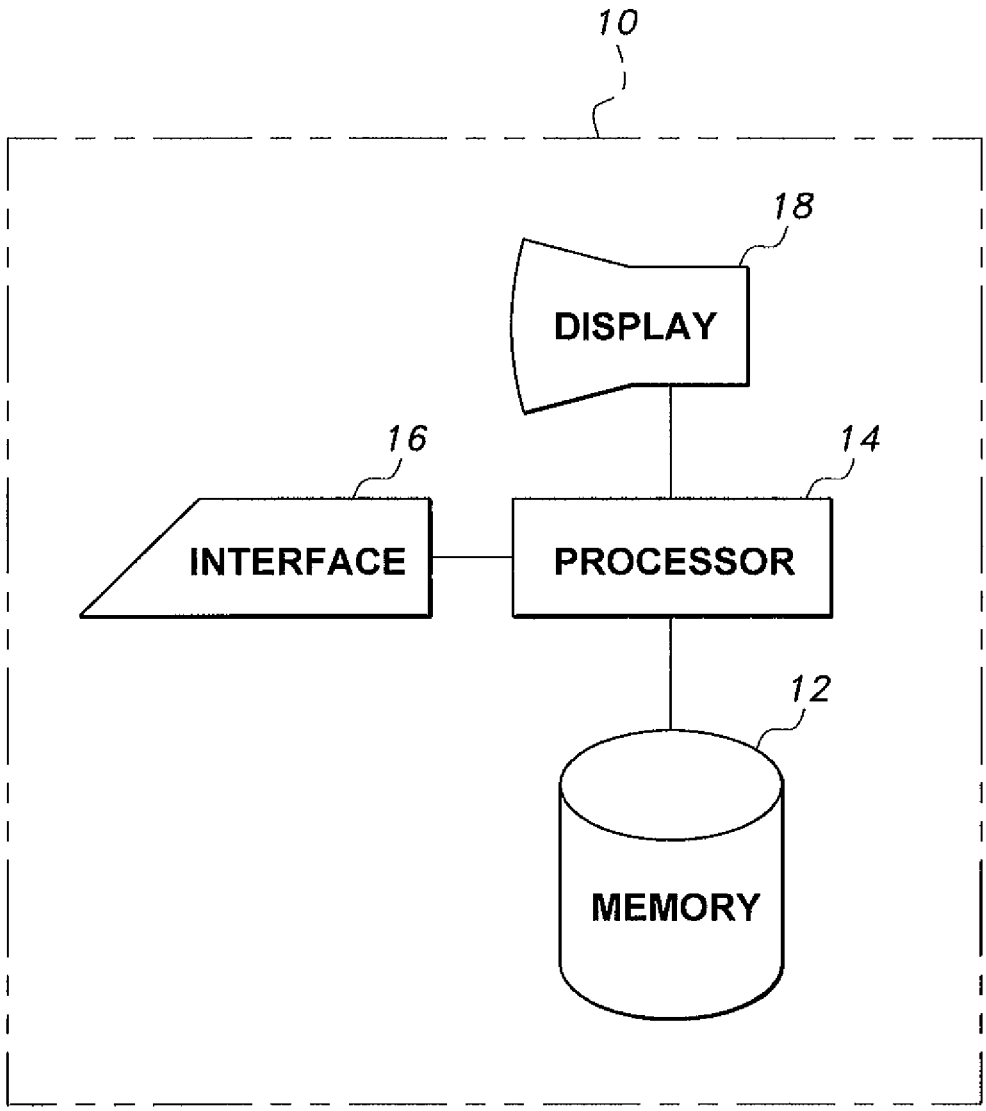
FIG. 15 is a block diagram illustrating system components for implementing the method of modeling fly ash collection efficiency in wire-duct electrostatic precipitators according to the present invention.

It should be understood that the calculations may be performed by any suitable computer system, such as that diagrammatically shown in FIG. 15. Data is entered into system 10 via any suitable type of user interface 16, and may be stored in memory 12, which may be any suitable type of computer readable and programmable memory. Calculations are performed by processor 14, which may be any suitable type of computer processor and may be displayed to the user on display 18, which may be any suitable type of computer display.

Processor 14 may be associated with, or incorporated into, any suitable type of computing device, for example, a personal computer or a programmable logic controller. The display 18, the processor 14, the memory 12 and any associated computer readable recording media are in communication with one another by any suitable type of data bus, as is well known in the art.

Examples of computer-readable recording media include a magnetic recording apparatus, an optical disk, a magneto-optical disk, and/or a semiconductor memory (for example, RAM, ROM, etc.). Examples of magnetic recording apparatus that may be used in addition to memory 12, or in place of memory 12, include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW.

It is to be understood that the present invention is not limited to the embodiments described above, but encompasses any and all embodiments within the scope of the following claims.

I claim:

1. A computer-implemented method of modeling fly ash collection efficiency in wire-duct electrostatic precipitators, comprising the steps of:

(a) modeling a monopolar corona of a wire-duct electrostatic precipitator as $\nabla\cdot\vec{E}=\rho/\in_0$, $\nabla\cdot\vec{J}=0$, $\vec{E}=-\nabla\phi$, $\vec{J}=\vec{J}_{io}+\vec{J}_p$, $\vec{J}_{io}=k_{io}\rho_{io}\vec{E}$, $\vec{J}_p=k_p\rho_p\vec{E}$, where $\vec{E}$ represents an electric field intensity vector, $\rho$ represents a total space charge density which is a summation of an ion charge density $\rho_{io}$ and a particle charge density $\rho_p$, $\vec{J}$ represents a total current density vector, $\vec{J}_{io}$ represents a current density vector for ions, $\vec{J}_p$ represents a current density vector for particles, $\phi$ represents a potential, $\in_0$ represents a permittivity of free space, and $k_{io}$ and $k_p$ represent mobilities for ions and particles, respectively, where the wire-duct electrostatic precipitator includes a pair of parallel plates with a plurality of discharging wires extending therebetween;

(b) generating a finite element boundary fitted grid matching a geometry of the wire-duct electrostatic precipitator, wherein the finite element boundary fitted grid is generated from an intersection of electric field lines, emanating from M finite element nodes selected on a circumference of each of the discharging wires, and N equipotential contours, wherein the intersection of the electric field lines with the N equipotential contours defines a plurality of quadrilaterals;

(c) calculating a set of estimated electric field magnitude values E at the M finite element nodes;

(d) dividing each of the quadrilaterals into a pair of triangles to generate a plurality of triangular finite elements;

(e) estimating the particle charge density $\rho_p$ at each of the nodes as $\rho_p=\in_0 f\, S_p\, E$, wherein f is a parameter dependent upon particle type;

(f) establishing a plurality of flux tubes in the finite element boundary fitted grid respectively about the plurality of electric field lines such that ionic space charges flow along centers of the plurality of flux tubes;

(g) estimating the ionic charge density $\rho_{io}$ along each of the flux tubes as $$\frac{d\rho_{io}}{dl}\hat{l} = -(\rho_{io}^2 + \rho_{io}\rho_p)/\varepsilon_0 E,$$

wherein $\hat{l}$ is a unit vector along an axis of the flux tube;

(h) approximating the potential $\phi$ within each of the finite elements as a linear function of coordinates as $\phi=\phi^e W^e=\phi_z w_z+\phi_s w_s+\phi_t w_t$, wherein z, s and t respectively represent nodes of element e, and w and W represent corresponding shape functions;

(i) estimating a nodal potential error $e_r$ for each node relative to an average potential value $\phi_{av}$ for the node;

(j) correcting an ionic space charge density $\rho_{i,1(io)}$ corresponding to an i-th flux tube if a maximum value of $e_r$ along the axis of the i-th flux tube exceeds a threshold value $\delta_1$;

(k) repeating steps (e) through (j) until the maximum value of $e_r$ is less than the threshold value $\delta_1$;

(l) regenerating the finite element boundary fitted grid and repeating steps (e) through (j) until self-consistent solutions for $\phi$ and $\rho$ are obtained and a maximum difference between ionic space charge densities at the finite element nodes is less than a second threshold value $\delta_2$;

(m) calculating a corona current I for each discharging wire as $$I = 4\sum_{i=1}^{M} J_i A_{i,1},$$

wherein $J_i$ represents per-unit current density at the i-th flux tube and $A_{i,1}$ represents a corresponding per-unit cross-sectional area; and (n) calculating precipitator efficiency as $$\%\ \eta = 1 - \frac{C_{out}}{C_{in}} \times 100,$$

wherein $C_{in}$ and $C_{out}$ represent particle concentration at a precipitator inlet and outlet, respectively, and are given by $$C_{out} = C_{in}\exp\left(\frac{-S_c E \rho_p}{Q}\right),$$

where $S_e$ represents a total collecting surface area and Q represents a gas flow rate;

wherein steps (a) through (n) are performed on a computer.

2. The computer-implemented method of modeling fly ash collection efficiency in wire-duct electrostatic precipitators as recited in claim 1, wherein the potential at each of the parallel plates is set to zero.

3. The computer-implemented method of modeling fly ash collection efficiency in wire-duct electrostatic precipitators as recited in claim 2, wherein an electric field at each of the discharging wires $E_0$ is given by $$E_0 = 3.1\times10^6\left(1+\frac{0.308}{\sqrt{0.5\times R}}\right),$$

wherein R represents a radius of each of the discharging wires.

4. The computer-implemented method of modeling fly ash collection efficiency in wire-duct electrostatic precipitators as recited in claim 3, wherein the step of calculating the set of estimated electric field magnitude values at the M finite element nodes includes calculation from a third order interpolating polynomial of the respective potentials.

5. The computer-implemented method of modeling fly ash collection efficiency in wire-duct electrostatic precipitators as recited in claim 4, wherein the parameter f is equal to 3 for conducting particles and the parameter f is equal to $$\frac{3\varepsilon}{\varepsilon+2}$$

for particles of relative permittivity $\in$.

6. The computer-implemented method of modeling fly ash collection efficiency in wire-duct electrostatic precipitators as recited in claim 5, wherein the step of correcting the ionic space charge density $\rho_{i,1(io)}$ includes establishing a new ionic space charge density $\rho_{i,1(io)new}$ given by $\rho_{i,1(io)new}=\rho_{i,1(io)}[1+g\,F_k]$, where i=1, 2, . . . , M, $e_r$ is updated as $$e_r = \frac{|\varphi_k^n - \varphi_k^{n+1}|}{\varphi_{av}},$$

n is an integer representing iteration number, $\phi_{av}=(\phi_k^n+\phi_k^{n+1})/2$, and $F_k$, is defined as $F_k$=Maximum $[(\phi_k^{n+1}-\phi_k^n)/\phi_{av}]$, where g is an accelerating factor and the number of flux tubes is equal to M.

7. The computer-implemented method of modeling fly ash collection efficiency in wire-duct electrostatic precipitators as recited in claim 6, wherein the accelerating factor g is set equal to 0.5.

8. The computer-implemented method of modeling fly ash collection efficiency in wire-duct electrostatic precipitators as recited in claim 7, wherein $\delta_2$ is set to 0.1%.

9. A system for modeling fly ash collection efficiency in wire-duct electrostatic precipitators, comprising:

a processor;

computer readable memory coupled to the processor;

a user interface coupled to the processor;

a display coupled to the processor;

software stored in the memory and executable by the processor, the software having:

means for modeling a monopolar corona of a wire-duct electrostatic precipitator as $\nabla\cdot\vec{E}=\rho/\in_0$, $\nabla\cdot\vec{J}=0$, $\vec{E}=-\nabla\phi$, $\vec{J}=\vec{J}_{io}+\vec{J}_p$, $\vec{J}_{io}=k_{io}\rho_{io}\vec{E}$, $\vec{J}_p=k_p\rho_p\vec{E}$, wherein $\vec{E}$ represents an electric field intensity vector, ρ represents a total space charge density which is a summation of an ion charge density $\rho_{io}$ and a particle charge density $\rho_p$, $\vec{J}$ represents a total current density vector, $\vec{J}_{io}$ represents a current density vector for ions, $\vec{J}_p$ represents a current density vector for particles, ϕ represents a potential, $\in_0$ represents a permittivity of free space, and $k_{io}$ and $k_p$ represent mobilities for ions and particles, respectively, where the wire-duct electrostatic precipitator includes a pair of parallel plates with a plurality of discharging wires extending therebetween;

means for generating a finite element boundary fitted grid matching a geometry of the wire-duct electrostatic precipitator, wherein the finite element boundary fitted grid is generated from an intersection of electric field lines, emanating from M finite element nodes selected on a circumference of each of the discharging wires, and N equipotential contours, wherein the intersection of the electric field lines with the N equipotential contours defines a plurality of quadrilaterals;

means for calculating a set of estimated electric field magnitude values E at the M finite element nodes;

means for dividing each of the quadrilaterals into a pair of triangles to generate a plurality of triangular finite elements;

means for estimating the particle charge density $\rho_p$ at each of the nodes as $\rho_p=\in_0 f\,S_p\,E$, wherein f is a parameter dependent upon particle type;

means for establishing a plurality of flux tubes in the finite element boundary fitted grid respectively about the plurality of electric field lines such that ionic space charges flow along centers of the plurality of flux tubes;

means for estimating the ionic charge density $\rho_{io}$ along each of the flux tubes as $$\frac{d\rho_{io}}{dl}\hat{l} = -(\rho_{io}^2+\rho_{io}\rho_p)/\varepsilon_0 E,$$

wherein $\hat{l}$ is a unit vector along an axis of the flux tube;

means for approximating the potential ϕ within each of the finite elements as a linear function of coordinates as $\phi=\phi^e W^e=\phi_z w_z+\phi_s w_s+\phi_t w_t$, wherein z, s and t respectively represent nodes of element e, and w and W represent corresponding shape functions;

means for estimating a nodal potential error $e_r$ for each node relative to an average potential value $\phi_{av}$ for the node;

means for correcting an ionic space charge density $\rho_{i,1(io)}$ corresponding to an i-th flux tube if a maximum value of $e_r$ along the axis of the i-th flux tube exceeds a threshold value $\delta_1$;

means for repeating the calculating of $e_r$ until the maximum value of $e_r$ is less than the threshold value $\delta_1$;

means for regenerating the finite element boundary fitted grid and repeating the calculating of $e_r$ until self-consistent solutions for ϕ and ρ are obtained and a maximum difference between ionic space charge densities at the finite element nodes is less than a second threshold value $\delta_2$;

means for calculating a corona current I for each discharging wire as $$I = 4\sum_{i=1}^{M} J_i A_{i,1},$$

wherein $J_i$ represents per-unit current density at the i-th flux tube and $A_{i,1}$ represents a corresponding per-unit cross-sectional area; and means for calculating precipitator efficiency as $$\% \ \eta = 1 - \frac{C_{out}}{C_{in}} \times 100,$$

wherein $C_{in}$ and $C_{out}$ represent particle concentration at a precipitator inlet and outlet, respectively, and are given by $$C_{out} = C_{in}\exp\left(\frac{-S_c E \rho_p}{Q}\right),$$

where $S_c$ represents a total collecting surface area and Q represents a gas flow rate.

10. The system for modeling fly ash collection efficiency in wire-duct electrostatic precipitators as recited in claim 9, wherein the potential at each of the parallel plates is set to zero.

11. The system for modeling fly ash collection efficiency in wire-duct electrostatic precipitators as recited in claim 10, wherein an electric field at each of the discharging wires $$E_0 \text{ is given by } E_0 = 3.1 \times 10^6\left(1 + \frac{0.308}{\sqrt{0.5 \times R}}\right),$$

wherein R represents a radius of each of the discharging wires.

12. The system for modeling fly ash collection efficiency in wire-duct electrostatic precipitators as recited in claim 11, wherein the means for calculating the set of estimated electric field magnitude values at the M finite element nodes includes means for calculation of the set of estimated electric field magnitude values from a third order interpolating polynomial of the respective potentials.

13. The system for modeling fly ash collection efficiency in wire-duct electrostatic precipitators as recited in claim 12, wherein the parameter f is equal to 3 for conducting particles and the parameter f is equal to $$\frac{3\varepsilon}{\varepsilon + 2}$$

for particles of relative permittivity $\in$.

14. The system for modeling fly ash collection efficiency in wire-duct electrostatic precipitators as recited in claim 13, wherein the means for correcting the ionic space charge density $\rho_{i,1(io)}$ includes means for establishing a new ionic space charge density $\rho_{i,1(io)new}$ given by $\rho_{i,1(io)new}=\rho_{i,1(io)}[1+g\ F_k]$, where i=1, 2, . . . , M, $e_r$ is updated as $$e_r = \frac{|\varphi_k^n - \varphi_k^{n+1}|}{\varphi_{av}},$$

n is an integer representing iteration number, $\phi_{av}=(\phi_k^n+\phi_k^{n+1})/2$, and $F_k$ is defined as $F_k$=Maximum$[(\phi_k^{n+}-\phi_k^n)/\phi_{av}]$, where g is an accelerating factor and the number of flux tubes is equal to M.

15. The system for modeling fly ash collection efficiency in wire-duct electrostatic precipitators as recited in claim 14, wherein the accelerating factor g is set equal to 0.5.

16. The system for modeling fly ash collection efficiency in wire-duct electrostatic precipitators as recited in claim 15, wherein $\delta_2$ is set to 0.1%.

17. A computer software product that includes a medium readable by a processor, the medium having stored thereon a set of instructions for modeling fly ash collection efficiency in wire-duct electrostatic precipitators, the instructions comprising:

(a) a first sequence of instructions which, when executed by the processor, causes the processor to model a monopolar corona of a wire-duct electrostatic precipitator as $\nabla\cdot\vec{E}=\rho/\in_0$, $\nabla\cdot\vec{J}=0$, $\vec{E}=-\nabla\phi$, $\vec{J}=\vec{J}_{io}+\vec{J}_p$, $\vec{J}_{io}=k_{io}\rho_{io}\vec{E}$, $\vec{J}_p=k_p\rho_p\vec{E}$, wherein $\vec{E}$ represents an electric field intensity vector, ρ represents a total space charge density which is a summation of an ion charge density $\rho_{io}$ and a particle charge density $\rho_p$, $\vec{J}$ represents a total current density vector, $\vec{J}_{io}$ represents a current density vector for ions, $\vec{J}_p$ represents a current density vector for particles, ϕ represents a potential, $\in_0$ represents a permittivity of free space, and $k_{io}$ and $k_p$ represent mobilities for ions and particles, respectively, where the wire-duct electrostatic precipitator includes a pair of parallel plates with a plurality of discharging wires extending therebetween;

(b) a second sequence of instructions which, when executed by the processor, causes the processor to generate a finite element boundary fitted grid matching a geometry of the wire-duct electrostatic precipitator, wherein the finite element boundary fitted grid is generated from an intersection of electric field lines, emanating from M finite element nodes selected on a circumference of each of the discharging wires, and N equipotential contours, wherein the intersection of the electric field lines with the N equipotential contours defines a plurality of quadrilaterals;

(c) a third sequence of instructions which, when executed by the processor, causes the processor to calculate a set of estimated electric field magnitude values E at the M finite element nodes;

(d) a fourth sequence of instructions which, when executed by the processor, causes the processor to divide each of the quadrilaterals into a pair of triangles to generate a plurality of triangular finite elements;

(e) a fifth sequence of instructions which, when executed by the processor, causes the processor to estimate the particle charge density $\rho_p$ at each of the nodes as $\rho_p={}_0 f\ S_p\ E$, wherein f is a parameter dependent upon particle type;

(f) a sixth sequence of instructions which, when executed by the processor, causes the processor to establish a plurality of flux tubes in the finite element boundary fitted grid respectively about the plurality of electric field lines such that ionic space charges flow along centers of the plurality of flux tubes;

(g) a seventh sequence of instructions which, when executed by the processor, causes the processor to estimate the ionic charge density $\rho_{io}$ along each of the flux tubes as $$\frac{d\rho_{io}}{dl}\hat{l} = -(\rho_{io}^2 + \rho_{io}\rho_p)/\varepsilon_0 E,$$

wherein $\hat{l}$ is a unit vector along an axis of the flux tube;

(h) an eighth sequence of instructions which, when executed by the processor, causes the processor to approximate the potential $\phi$ within each of the finite elements as a linear function of coordinates as $\phi=\phi^e W^e=\phi_z w_z+\phi_s w_s+\phi_t w_t$, wherein z, s and t respectively represent nodes of element e, and w and W represent corresponding shape functions;

(i) a ninth sequence of instructions which, when executed by the processor, causes the processor to estimate a nodal potential error $e_r$ for each node relative to an average potential value $\phi_{av}$ for the node;

(j) a tenth sequence of instructions which, when executed by the processor, causes the processor to correct an ionic space charge density $\rho_{i,1(io)}$ corresponding to an i-th flux tube if a maximum value of $e_r$ along the axis of the i-th flux tube exceeds a threshold value $\delta_1$;

(k) an eleventh sequence of instructions which, when executed by the processor, causes the processor to repeat the fifth set of instructions through the tenth set of instructions until the maximum value of $e_r$ is less than the threshold value $\delta_1$;

(l) a twelfth sequence of instructions which, when executed by the processor, causes the processor to re-generate the finite element boundary fitted grid and repeat the fifth set of instructions through the tenth set of instructions until self-consistent solutions for $\phi$ and $\rho$ are obtained and a maximum difference between ionic space charge densities at the finite element nodes is less than a second threshold value $\delta_2$;

(m) a thirteenth sequence of instructions which, when executed by the processor, causes the processor to calculate a corona current I for each discharging wire as $$I = 4\sum_{i=1}^{M} J_i A_{i,1},$$

wherein $J_i$ represents per-unit current density at the i-th flux tube and $A_{i,1}$ represents a corresponding per-unit cross-sectional area; and (n) a fourteenth sequence of instructions which, when executed by the processor, causes the processor to calculate precipitator efficiency as $$\%\ \eta = 1 - \frac{C_{out}}{C_{in}} \times 100,$$

wherein $C_{in}$ and $C_{out}$ represent particle concentration at a precipitator inlet and outlet, respectively, and are given by $$C_{out} = C_{in}\exp\left(\frac{-S_c E \rho_p}{Q}\right),$$

where $S_c$ represents a total collecting surface area and Q represents a gas flow rate.

18. The computer software product as recited in claim 17, wherein the instructions further comprise:

o) a fifteenth set of instructions which, when executed by the processor, causes the processor to set the potential at each of the parallel plates to zero;

p) a sixteenth set of instructions which, when executed by the processor, causes the processor to set an electric field at each of the discharging wires $E_0$ to $$E_0 = 3.1 \times 10^6\left(1 + \frac{0.308}{\sqrt{0.5 \times R}}\right),$$

wherein R represents a radius of each of the discharging wires; and q) a seventeenth set of instructions which, when executed by the processor, causes the processor to calculate the set of estimated electric field magnitude values at the M finite element nodes through calculation from a third order interpolating polynomial of the respective potentials.

19. The computer software product as recited in claim 18, wherein the instructions further comprise:

r) an eighteenth set of instructions which, when executed by the processor, causes the processor to set the parameter f equal to 3 for conducting particles and set the parameter f equal to $$\frac{3\varepsilon}{\varepsilon + 2}$$

for particles of relative permittivity $\in$; and s) a nineteenth set of instructions which, when executed by the processor, causes the processor to establish a new ionic space charge density $\rho_{i,1(io)new}$ given by $\rho_{i,1(io)new}=\rho_{i,1(io)}[1+g\ F_k]$, where i=1, 2, . . . , M, $e_r$ is updated as $$e_r = \frac{|\varphi_k^n - \varphi_k^{n+1}|}{\varphi_{av}},$$

n is an integer representing iteration number, $\phi_{av}=(\phi_k^n+\phi_k^{n+1})/2$, and $F_k$ is defined as $F_k=\text{Maximum}[(\phi_k^{n+1}-\phi_k^n/\phi_{av}]$, where g is an accelerating factor and the number of it flux tubes is equal to M.

20. The computer software product as recited in claim 19, wherein the instructions further comprise:

t) a twentieth set of instructions which, when executed by the processor, causes the processor to set the accelerating factor g equal to 0.5; and u) a twenty-first set of instructions which, when executed by the processor, causes the processor to set the second threshold value $\delta_2$ to 0.1%.

* * * * *